US007969127B1

(12) United States Patent
Megaw

(10) Patent No.: US 7,969,127 B1
(45) Date of Patent: Jun. 28, 2011

(54) START-UP CIRCUIT FOR A SHUNT REGULATOR

(75) Inventor: David James Megaw, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 493 days.

(21) Appl. No.: 12/110,168

(22) Filed: Apr. 25, 2008

(51) Int. Cl.
*G05F 1/613* (2006.01)

(52) U.S. Cl. ..... 323/226; 323/274; 323/901

(58) Field of Classification Search ..... 323/226, 323/274, 901
See application file for complete search history.

(56) References Cited

U.S. PATENT DOCUMENTS

| | | | | |
|---|---|---|---|---|
| 4,879,506 | A | 11/1989 | Braun | |
| 5,229,708 | A | 7/1993 | Donig et al. | |
| 5,554,924 | A | 9/1996 | McMahon et al. | |
| 5,666,044 | A | 9/1997 | Tuozzolo | |
| 5,668,467 | A | 9/1997 | Pease | |
| 6,275,017 | B1 | 8/2001 | Germanski et al. | |
| 6,696,822 | B2 * | 2/2004 | Takabayashi | 323/224 |
| 6,707,280 | B1 * | 3/2004 | Liu et al. | 323/224 |
| 6,737,908 | B2 | 5/2004 | Mottola et al. | |

* cited by examiner

*Primary Examiner* — Jeffrey L Sterrett

(57) ABSTRACT

A method and circuit for controlling the start-up of a shunt regulator that uses an error amplifier for normal operation in a linear range of a target value output voltage set by a reference voltage upon circuit start-up clamps the output voltage to a first level value below the target value, next applies regenerative positive feedback independent of the error amplifier to force the output voltage through a range where adverse conditions can occur to a second level value below the target value, and then releases the positive feedback near the target value where the error amplifier assumes control of the regulation.

21 Claims, 2 Drawing Sheets

Fig. 1
(Prior Art)
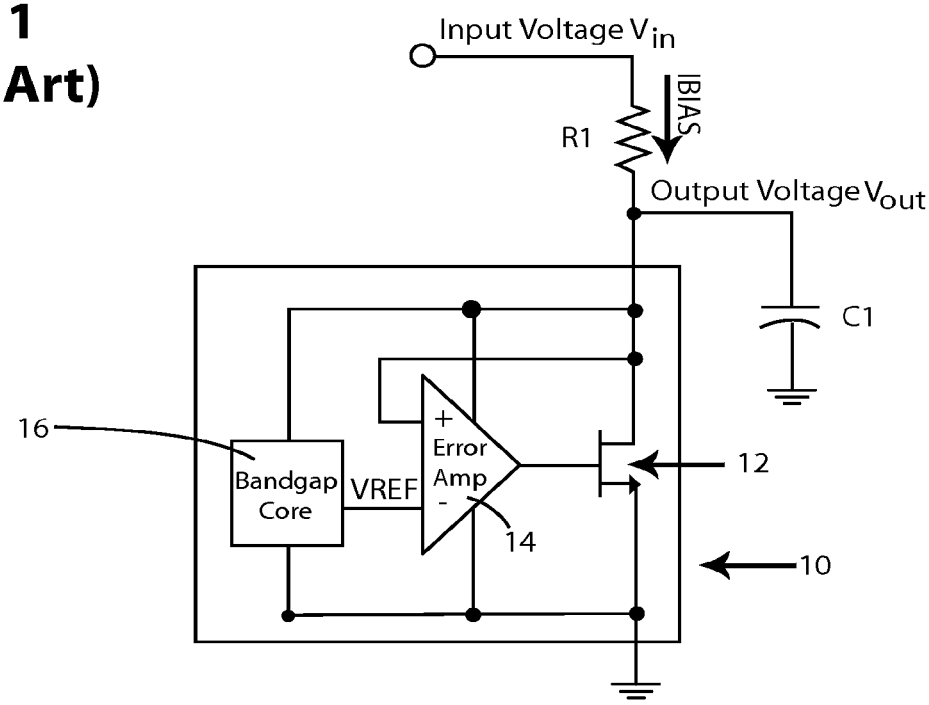
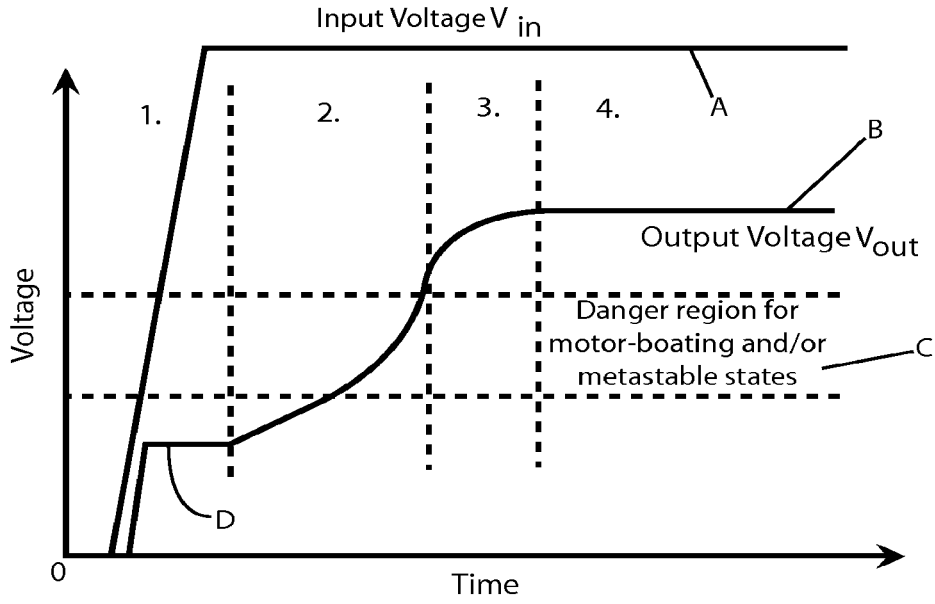
Fig. 2

START-UP CIRCUIT FOR A SHUNT REGULATOR

FIELD OF THE INVENTION

The invention relates to a shunt regulator having a circuit to improve its start-up characteristics for operating with various types of external components and factors.

BACKGROUND OF THE INVENTION

The start-up behavior of many linear integrated circuits is determined by external component selection. This is particularly true for a shunt regulator that operates over a wide range of voltages and has various types of external components interfaced with it. In order to allow flexibility for the end-user, it is desirable to have the shunt regulator circuit operate over a large range of external factors, such as input voltage, and components such as input and output capacitors, etc.

FIG. 1 shows the fundamentals of a typical closed loop type linear shunt regulator 10. The regulator has a device 12 such as a transistor for shunting excess bias current to ground to maintain regulation. The transistor is of suitable capacity for the amount of current being regulated. Input voltage Vin is supplied through a resistor R1 to the regulating device 12 drain. The source of the device 12 is connected to ground. An output bypass capacitor C1 has one end connected to the junction of the device 12 drain and R1 and the other end connected to ground. The regulator output voltage Vout is taken at the upper end of C1, which is included to reduce noise and improve transient response. The resistor R1 sets a value of a current IBIAS that is determined by the formula:

$$IBIAS = \frac{\text{Input Voltage} - \text{Output Voltage}}{R1}$$

The regulator 10 is a closed loop type circuit that has an error amplifier 14 whose output is connected to the gate electrode of the regulating device 12 to control its conduction state. The negative (inverting) input to the error amplifier 14 is a highly stable reference voltage, Vref, from a bandgap core 16, which is the target value for the regulator output voltage Vout. Many conventional circuits are known for implementing the bandgap core 16. The bandgap core 16 is connected between a point of Vout and ground to receive an operating voltage. The error amplifier 14 positive (non-inverting) input is the voltage Vout which completes the closed loop. The regulator 10 operates so that if the voltage Vout exceeds the reference voltage Vref applied to the error amplifier 14, then the error amplifier 14 produces an output signal that causes device 12 to conduct current, which it dissipates as heat. This regulates the output voltage Vout to be at the target value.

When a regulator circuit such as that shown in FIG. 1 is turned on, it takes some time for the circuit components to stabilize so that it will be operating in a linear range of the error amplifier 14 in which it is able to regulate Vout. The start-up requirements of a typical shunt regulator such as that of FIG. 1 are principally determined by the values of the bypass capacitor C1 and the bias current setting resistor R1. If C1 ranges from 10 pF to 10 μF, and IBIAS ranges from 10 μA to 10 mA then the start-up time constant can vary by as much as nine orders of magnitude. The start up time constant is defined as the time required for the regulation loop to reach its linear operating range as set by the external factors and component values. In practical terms, this means that the shunt regulator must be able to respond in nanoseconds to prevent large amounts of Vout overshoot from the target value when C1 is small and IBIAS is large. Conversely, the regulator must avoid motor-boating and meta-stable states with long start-up time constants of seconds due to a large C1 value and a small IBIAS value.

Conventional shunt regulators allow the start-up to be controlled by the error amplifier steady-state regulation loop. The minimum start-up time constant to avoid Vout output overshoot is limited by the amount of time it takes for the regulation loop to become biased into its linear operating region and also the bandwidth of the error amplifier. This generally requires tens to hundreds of microseconds. Very large start-up time constants (seconds) increase the likelihood that the loop will motor-boat or get trapped in a metastable state because the loop is held out of its linear regulating region for long portions of the start-up time and its ability to control the output voltage varies.

The steady-state regulation loop is typically optimized and compensated for steady-state operation and not for start-up behavior. The steady state regulation loop requires certain bias conditions and a certain amount of time to behave in a predictable, well controlled manner. Either one or both of these factors are not met over certain ranges of start-up time constants.

Accordingly, a need exists to provide a shunt regulator that does not have the above-described disadvantages of the prior art circuits, even though the external factors and components of the circuit might vary over a large range.

BRIEF DESCRIPTION OF THE INVENTION

The present invention provides a circuit for ensuring reliable and well-controlled start-up in a shunt regulation loop over very large ranges of external factors and components that could normally cause a large range of start-up time constants. The invention supplements the error amplifier regulation loop's control of the output voltage during start-up using a circuit that is not dependent on the loop's linear operating region. The circuit has several sequential operating states. First, when the regulator is first powered up, there is a clamped state that holds the output voltage to a low level and prevents overshoot. The clamped state can be designed to respond in nanoseconds because it does not require the regulation loop to be in its linear operating region, nor does it rely on the error amplifier's bandwidth. In the next state, a positive feedback loop pulls the circuit out of the clamped state and forces Vout towards its target value. With the circuit being under the control of the positive feedback loop, motor-boating and meta-stable states are prevented since the feedback loop forces a transition of the output voltage towards steady-state operation at the target voltage value. The regenerative nature of the positive feedback means the regulation loop need not be in its linear region to force the transition. While under the control of the positive feedback loop, the output voltage is dependent on an internally-set positive feedback factor and is substantially independent of external factors such as IBIAS and the value of the bypass capacitor. Once the positive feedback loop has forced Vout to near its desired value, e.g. 80-90% of its target value, where the regulation loop is known to be in its linear operating region, control of the loop is released to the error amplifier allowing it to smoothly reach the output voltage's steady-state target value and thereafter control regulation in the normal manner.

The circuit operates in a manner such that the regulator start-up behavior is well controlled over a large range of start-up time constants giving more flexibility for external component selection. The shunt regulator circuit of the invention overcomes overshoot and meta-stable states present in a conventional shunt regulation loop.

BRIEF DESCRIPTION OF THE DRAWINGS

Other objects and advantages of the present invention will become more apparent upon reference to the following specification and annexed drawings, in which:

FIG. 1 is a drawing illustrating the operation of prior art circuits;

FIG. 2 shows various operational states of the shunt regulator of the invention.

DETAILED DESCRIPTION OF THE INVENTION

Figure 3:
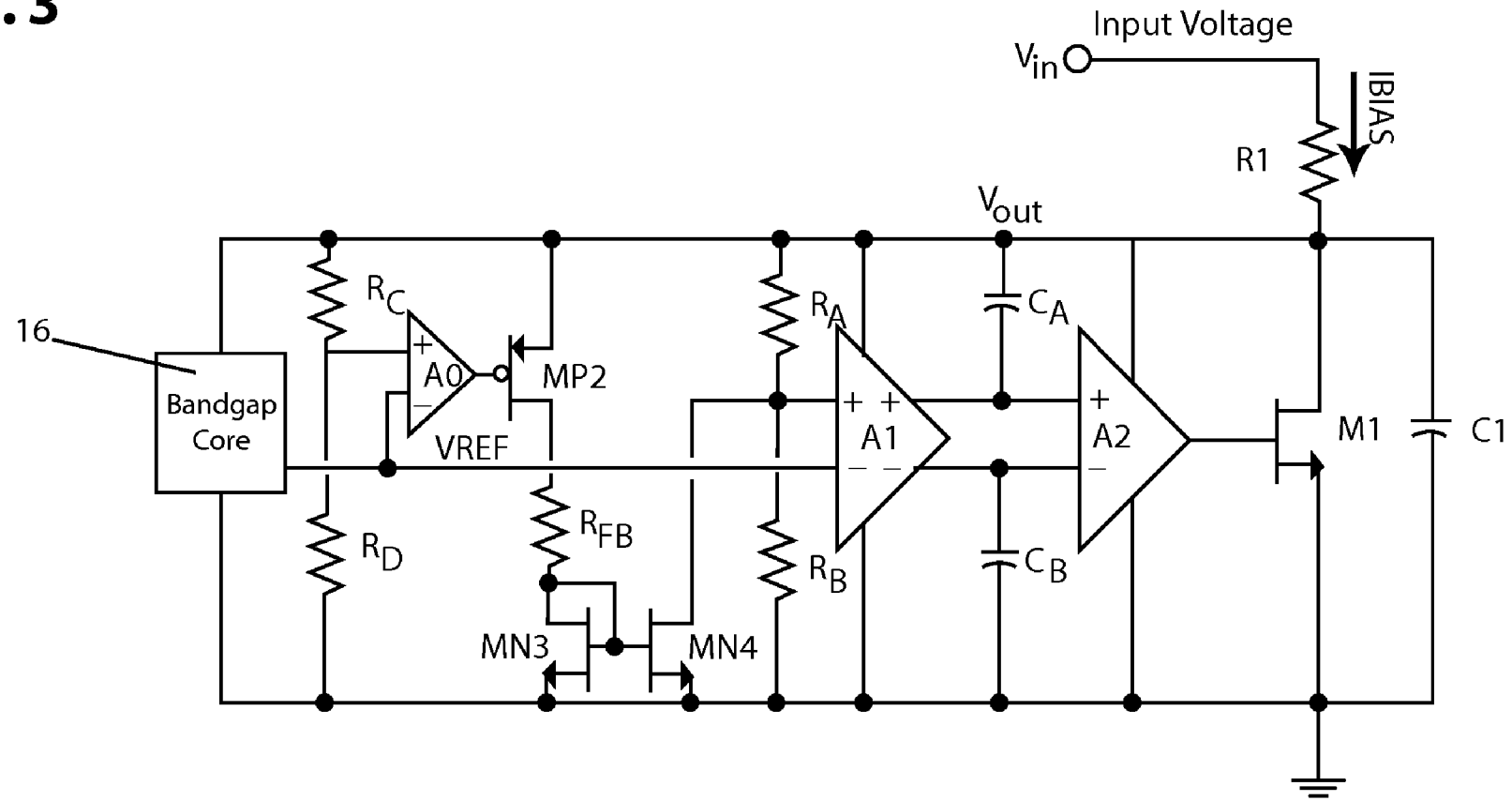
FIG. 3 is a schematic diagram of the circuit in accordance with the present invention.

FIG. 2 is a chart showing the operational states of the circuit of the shunt regulator of the invention, a preferred embodiment of which is shown in FIG. 3 described below. The shunt regulator of FIG. 3 has an error amplifier that performs the function described above with respect to FIG. 1. The FIG. 2 chart ordinate is voltage, and the abscissa is time. Line A is the input voltage Vin to the circuit, and line B is the output voltage Vout. The circuit has four states of operation, which are shown numbered 1-4 relative to the time axis. The area C is a region of the output voltage Vout below where the regulation loop reaches its normal linear operating region and during which motor-boating and meta-stable states exist.

In the first state 1, the circuit is turned on at time zero, and after a brief delay the input voltage Vin shown in line A rises from zero to its more normal value range that occurs during all four states of the start-up. During the time of state 1, the output voltage Vout shown by line B first starts to rise and is clamped at a level D, which is below the danger region C. The clamped level D prevents overshoot of the output voltage when the circuit is first powered up. The clamped level is maintained throughout state 1, during which time the input voltage A reaches its more normal value.

During state 2, a positive feedback loop of the circuit takes over to drive or pull the output voltage Vout upwardly towards its final value. The positive feedback loop pulls the circuit out of the clamped state 1 and drives Vout through region C. This prevents motor-boating and meta-stable states since the positive feedback loop forces the transition of Vout through the danger region C. The regenerative nature of the positive feedback means that the error amplifier regulation loop does not have to be in its linear operating region to force the transition. This makes the start-up much less dependent on bias conditions.

At the beginning of state 3, the output voltage Vout has reached a value near its normal target value, about 80- 90% in a preferred embodiment of the invention although other values can be selected. At this point, the regulation loop is in its linear region of operation. At this time, the positive feedback loop releases control of the regulation to the error amplifier to permit normal regulation to take over, allowing the output voltage to smoothly reach its steady-state target value. Regulation is performed by the error amplifier to finish the transition of the output voltage to its target value by the end of state 3. In state 4, the error amplifier regulation loop is operating normally in its linear region.

FIG. 3 shows a preferred embodiment of the circuit of the invention. In this circuit, all of the transistors are of the MOS type with the N or P of its reference number designating the transistor as being of the NMOS or PMOS type. Of course, other types of transistors also can be used. The conductivity types of the transistors can vary depending upon the polarity of the voltage being regulated. Like the circuit of FIG. 1, there is a source of input voltage Vin that is applied through a resistor R1 to the drain electrode of a shunt regulating transistor M1 (an NMOS transistor), whose source is connected to ground. The circuit output voltage Vout appears at the junction of the resistor R1, the transistor M1 drain, and a bypass capacitor C1 that is connected from the Vout terminal to ground.

An operational amplifier A2 has its output connected to the gate electrode of the transistor M1. A compensation capacitor CA is connected from the amplifier A2 positive (non-inverting) input to the Vout line, and another compensation capacitor CB is connected from the A2 negative (inverting) input to ground. As explained below, amplifier A2 and the capacitors form the clamping part of the circuit corresponding to state 1 of the start-up process. The vertical lines connected between the amplifier A2 and Vout and ground are for the amplifier's operating voltage supply.

There is the bandgap core circuit 16 connected between the output voltage and ground that produces a reference voltage Vref applied to one (illustratively the negative) input of an operational amplifier A1. The inverted output of the amplifier A1 is connected to the inverting input of amplifier A2. The positive input of amplifier A1 receives Vout from the junction of a voltage divider formed by resistors RA and RB connected between Vout and ground. The positive non-inverted output of amplifier A1 is connected to the positive input of A2. The cascade of amplifiers A1 and A2 forms the error amplifier, which closes the regulation loop.

The part of the circuit that produces the positive feedback for state 2 of the start-up process is formed by amplifier A1, the voltage divider RA - RB, and a transistor MN4 having (i) its drain connected to the RA - RB junction and the amplifier A1 positive input and its (ii)source connected to ground.

The state 3 part of the process for releasing the positive feedback is accomplished by a comparator A0, whose positive input receives Vout from the junction of a voltage divider RC and RD connected between the Vout line and ground. The negative input to A0 is Vref from the bandgap core 16. The output of amplifier A0 is connected to the gate of a transistor MP2, whose source is connected to Vout and whose drain is connected through a resistor RFB to the drain of a transistor MN3, whose source is connected to ground. Resistor RFB also is connected to the gates of both MN3 and MN4.

In the operation of the circuit of FIG. 3, at initial start-up the dominant clamp of state 1 is formed by the pull-down transistor regulating device M1 driven by amplifier A2. A systematic offset can be designed into A2 so that the default state of its output approaches the positive rail Vout during initial start-up regardless of whether A2 is operating linearly or not. Additionally, the compensation capacitors CA and CB force the clamped state for very small start-up time constants because the injected signal into the positive input of A2 will be proportional to the dV/dt of the output voltage Vout. As the supply voltage for amplifier A2 is Vout, it must be able to drive the gate of M1 nearly to Vout when it is only being powered by a supply voltage equal to the clamped voltage. Therefore, A2 should be designed to operate at supply voltages less than or equal to the clamp voltage, although it does not necessarily have be operating linearly in that region. The circuit of FIG. 3 can be designed to achieve the clamped level state 1 in nanoseconds because it does not require its error amplifier regulation loop to be in its linear operating region and it does not rely on the error amplifier's bandwidth.

The positive feedback loop is formed by pulling a current proportional to the output voltage Vout out of the positive input of amplifier A1. Normally, the voltage at the positive input of A1 is set by the voltage divider formed by resistors RA and RB. The divider formed by RA and RB creates the feedback factor, which establishes the steady-state output voltage as a function of Vref. Vout=Vref * ((RA+RB)/RB). Pulling a current proportional to the output voltage Vout from the junction of the RA and RB divider creates the positive feedback path, and disabling this current returns the loop to normal steady-state control through the error amplifier A1-A2. Pulling a current from the junction of RA and RB lowers the voltage at the positive input of A1, causing amplifier A2 to lower the gate voltage of M1, thereby causing Vout to increase because M1 is conducting less current.

Since the current pulled from the RA and RB junction is proportional to Vout, a positive feedback loop is created because the magnitude of the signal forcing Vout to increase is itself dependent on Vout. The current proportional to Vout is set by the value of RFB and is equal to Vout−VGS_MN3)/RFB assuming a negligible voltage drop across transistor MP2, which is operating like a switch. The resistive divider formed by resistors RC and RD and comparator A0 form a threshold detector, which terminates the positive feedback loop by forcing MP2 into its non-conducting state and causing the current flowing through transistors MN3 and MN4 to go to zero. MP2 is turned off when the voltage at the junction of the RC and RD resistive divider exceeds Vref. The values of RC and RD are chosen to determine how close to the steady-state output voltage Vout must be before the positive feedback path is broken. RD/(RC+RD)=K*(RB/(RA+RB)), where K is the ratio of the Vout value where the positive feedback path is broken to the steady-state Vout. This completes state 3. Thereafter, the circuit operates in the normal manner in state 4, with amplifiers A1 and A2 forming the error amplifier loop.

The present invention affords more flexibility in use of a range of external component selection to make the use of linear shunt regulator circuits more attractive without having the external components adversely affect start-up behavior. The invention reduces the extremes of start-up time constants that complicate circuit design. The use of a dominant clamp and a temporary positive feedback loop to control start-up can react much faster, work over a wider range of bias conditions, and does not rely on the linearity of the regulation loop in order to work properly thereby increasing the range of start-up time constants with which the circuit can operate.

Specific features of the invention are shown in one or more of the drawings for convenience only, as each feature may be combined with other features in accordance with the invention. Alternative embodiments will be recognized by those skilled in the art and are intended to be included within the scope of the claims. Accordingly, the above description should be construed as illustrating and not limiting the scope of the invention. All such obvious changes and modifications are within the patented scope of the appended claims.

I claim:

1. A shunt regulator circuit comprising:

a regulating device configured to receive an input voltage and whose degree of conduction is controllable to control production of an output voltage at a terminal;

a source configured to produce a reference voltage that sets a target value for the output voltage;

an error amplifier configured to produce an output signal to control the conduction of the regulating device in response to comparing the output voltage and the reference voltage; and a control circuit configured to operate the regulating device to (i) first clamp the output voltage at a first level value below the target value, (ii) then force the output voltage to reach a second level value still below the target value, and (iii) then permit the output signal of the error amplifier to control the conduction of the regulating device to produce the output voltage at the target value.

2. The circuit as claimed in claim 1, wherein the control circuit is configured to operate independently of a normal regulating function of the error amplifier to force the output voltage from the first level value to the second level value.

3. The circuit as claimed in claim 1, wherein the control circuit includes a positive feedback loop for the error amplifier that is configured to force the regulating device to become less conductive to thereby increase the output voltage from the first level value toward the second level value.

4. The circuit as claimed in claim 3, wherein the feedback loop is configured to operate independently of a normal regulating function of the error amplifier to force the output voltage from the first level value to the second level value.

5. The circuit as claimed in claim 3, wherein the feedback loop comprises:

a voltage divider comprising first and second resistors connected between the terminal and a point of reference potential;

an input to the error amplifier from a junction of the first and second resistors; and a first transistor connected between the junction and the point of reference potential.

6. The circuit as claimed in claim 5, wherein the control circuit includes a switching circuit that is configured to disable the positive feedback loop when the output voltage has reached the second level value by making the first transistor non-conductive.

7. The circuit as claimed in claim 3, wherein the control circuit includes a switching circuit that is configured to disable the positive feedback loop when the output voltage has reached the second level value.

8. The circuit as claimed in claim 7, wherein the second level value is in a range of between about 80% and 90% of the target value.

9. The circuit of claim 7, wherein the control circuit comprises a switching circuit, wherein the switching circuit comprises:

a second voltage divider comprising third and fourth resistors connected between the terminal and the point of reference potential;

a comparator configured to receive as one input a voltage from a junction of the third and fourth resistors that sets the second level value, to receive as another input the reference voltage, and to produces a second output signal; and a second transistor connected to the first transistor and configured to receive the second output signal and to make the first transistor non-conductive to disable the feedback loop.

10. The circuit as claimed in claim 9, wherein the control circuit includes the error amplifier, which is configured to clamp the output voltage to the first level value.

11. The circuit as claimed in claim 1, wherein the control circuit includes the error amplifier, which is configured to clamp the output voltage to the first level value.

12. The circuit as claimed in claim 11, wherein:

the error amplifier comprises first and second operational amplifiers connected in cascade;

the first operational amplifier is configured to receive the reference voltage at an inverting input and a fraction of the output voltage at a non-inverting input, the first operational amplifier having respective inverting and non-inverting outputs connected to corresponding inverting and non-inverting inputs of the second operational amplifier; and the second operational amplifier has an output connected to a control electrode of the regulating device to control its conduction.

13. The circuit as claimed in claim 12, further comprising:

a first capacitor connected between (i) one of the inverting and non-inverting inputs of the second operational amplifier and (ii) the terminal; and a second capacitor connected between (i) the other of the inverting and non-inverting inputs of the second operational amplifier and (ii) a point of reference potential.

14. The circuit as claimed in claim 12, wherein the control circuit includes a positive feedback loop for the error amplifier that is configured to force the regulating device to become less conductive to thereby increase the output voltage from the first level value toward the second level value, wherein the positive feedback loop comprises:

a voltage divider comprising first and second resistors connected between the terminal and a point of reference potential, the voltage divider configured to apply a fraction of the output voltage to the non-inverting input of the first operational amplifier from a junction of the first and second resistors; and a first transistor connected between the junction and the point of reference potential.

15. The circuit as claimed in claim 14, wherein the control circuit includes a switching circuit that is configured to disable the positive feedback loop when the output voltage has reached the second level value.

16. The circuit of claim 15, wherein the switching circuit comprises:

a second voltage divider comprising third and fourth resistors connected between the terminal and the point of reference potential;

a comparator configured to receive as one input a voltage from a junction of the third and fourth resistors that sets the second level value, to receive as another input the reference voltage, and to produces a second output signal; and a second transistor connected to the first transistor and configured to receive the second output signal and to make the first transistor non-conductive to disable the feedback loop.

17. A method of providing fast start-up for a shunt regulator circuit, comprising the steps of:

producing a reference voltage that sets a target value for an output voltage using a reference voltage source;

producing an output signal to control conduction of a regulating device by comparing the output voltage and the reference voltage using an error amplifier, wherein the conduction of the regulating device is controllable to control production of the output voltage; and operating the regulating device to (i) first clamp the output voltage at a first level value below the target value, (ii) then force the output voltage to reach a second level value still below the target value, and (iii) then permit the output signal of the error amplifier to control the conduction of the regulating device to produce the output voltage at the target value.

18. The method as claimed in claim 17, wherein a control circuit is operated independently of a normal regulating function of the error amplifier to force the output voltage from the first level value to the second level value.

19. A shunt regulator circuit comprising:

a regulating device configured to receive an input voltage, the regulating device having a degree of conduction that is controllable to control generation of an output voltage;

an error amplifier configured to compare (i) one of the output voltage and a first fraction of the output voltage and (ii) a reference voltage that sets a target value for the output voltage, the error amplifier also configured to generate a first output signal to control the conduction of the regulating device;

a first transistor connected to an input of the error amplifier and to ground;

a comparator configured to compare (i) one of the output voltage and a second fraction of the output voltage and (ii) the reference voltage, the comparator also configured to generate a second output signal; and a second transistor configured to make the first transistor non-conductive based on the second output signal.

20. The shunt regulator circuit of claim 19, wherein:

the error amplifier comprises first and second operational amplifiers, the first operational amplifier configured to receive the reference voltage at an inverting input and the first fraction of the output voltage at a non-inverting input, the first operational amplifier having inverting and non- inverting outputs connected respectively to inverting and non-inverting inputs of the second operational amplifier, the second operational amplifier having an output connected to a control electrode of the regulating device; and the shunt regulator circuit further comprises:

a first voltage divider configured to generate the first fraction of the output voltage and to provide the first fraction of the output voltage to the non-inverting input of the first operational amplifier;

first and second compensation capacitors connected respectively to the inverting and non-inverting inputs of the second operational amplifier; and a second voltage divider configured to generate the second fraction of the output voltage and to provide the second fraction of the output voltage to the comparator.

21. The shunt regulator circuit of claim 20, wherein the shunt regulator circuit is configured to (i) first clamp the output voltage at a first level value below the target value, (ii) then force the output voltage to reach a higher second level value below the target value, and (iii) then permit the first output signal of the error amplifier to control the conduction of the regulating device to generate the output voltage at the target value.

* * * * *